US007747035B1

(12) United States Patent
Heavner

(10) Patent No.: US 7,747,035 B1
(45) Date of Patent: Jun. 29, 2010

(54) UNIPOLE RADIATOR LOUDSPEAKER

(76) Inventor: Leslie A. Heavner, 16 Ashcroft Dr., Fredericksburg, VA (US) 22405-5781

( * ) Notice: Subject to any disclaimer, the term of this patent is extended or adjusted under 35 U.S.C. 154(b) by 1233 days.

(21) Appl. No.: 11/298,657

(22) Filed: Dec. 12, 2005

(51) Int. Cl.
*H04R 25/00* (2006.01)

(52) U.S. Cl. ..... 381/398; 381/408; 381/431

(58) Field of Classification Search ..... 381/152, 381/398, 399, 401, 402, 408, 431, 184, 186, 381/182; 181/171, 172, 173
See application file for complete search history.

(56) References Cited

U.S. PATENT DOCUMENTS

| | | | | |
|---|---|---|---|---|
| 4,468,530 | A * | 8/1984 | Torgeson | 381/402 |
| 4,792,978 | A * | 12/1988 | Marquiss | 381/431 |
| 5,081,683 | A * | 1/1992 | Torgeson | 381/182 |
| 5,157,731 | A | 10/1992 | Mitobe | |
| 5,317,642 | A | 5/1994 | Danley et al. | |
| 6,834,114 | B2 | 12/2004 | Kobayashi et al. | |
| 7,480,392 | B2 * | 1/2009 | Shin et al. | 381/419 |

FOREIGN PATENT DOCUMENTS

GB 325543 2/1930

* cited by examiner

*Primary Examiner*—Huyen D Le
(74) *Attorney, Agent, or Firm*—Patent & Trademark Services, Inc; Joseph H. McGlynn

(57) ABSTRACT

A loudspeaker having a diaphragm with a fixed edge and a free edge, and a multiplicity of conductors running parallel to its length and adjacent to the free edge.

13 Claims, 2 Drawing Sheets

UNIPOLE RADIATOR LOUDSPEAKER

BACKGROUND OF THE INVENTION

This invention relates, in general, to loudspeakers, and, in particular, to loudspeakers having a diaphragm which has oscillatory movements that describe an arc during use.

DESCRIPTION OF THE PRIOR ART

In the prior art various types of devices have been proposed. For example, U.S. Pat. No. 5,317,642 to Danley et al discloses a loudspeaker having a radiator with a free edge, and the free edge is positioned between the opposite poles of a magnet.

British patent No. 325,543 to Pollock et al discloses a loudspeaker which has a diaphragm that moves in an arc.

U.S. Pat. No. 5,157,731 to Mitobe discloses a dome speaker having a diaphragm, an annular voice coil housing with a U-shaped section surrounding the diaphragm.

U.S. Pat. No. 6,834,114 to Kobayashi et al discloses a multifunction acoustic device with a diaphragm supported in a frame and a voice coil secured to the diaphragm and inserted in a gap in a permanent magnet.

In a conventional cone loudspeaker, a combination of outer cone suspension and spider provides the centering mechanism for the voice coil and cone and contributes to the restorative force necessary to bring the cone and voice coil back to its original position after completion of an audio cycle. In the present invention the semi-rigid diaphragm may act as the restorative mechanism, and the voice coil is kept within close proximity to the magnet structure at all times since the opposing edge of the diaphragm is fixed. This precludes the possibility of the diaphragm hitting the magnet structure.

Another advantage of the present invention is the voice coil is spread out over a relatively large surface area, thereby aiding in cooling. Another advantage of the present invention is the transducers are essentially planer and represent a viable solution to mounting in difficult places such as within house walls and ceilings or in automobiles. Another advantage to the present invention is there is no restriction in its dynamic capabilities. Both electrostatic and magnetic planar loudspeakers have a tightly stretched membrane affixed to a frame about their perimeter. When called upon to produce sudden dynamic peaks, they are unable to do so since the membrane is stretched so tightly. Also, in a single ended magnetic planar loudspeaker there is a significant departure of the conductive elements from their magnetic structure due to the layout of the drive mechanism. This results in distortion of the audio signal. Push-pull magnetic planar loudspeakers are better in this regard but suffer from cavity resonances due to the physical structures now on both sides of the diaphragm. The present invention overcomes this shortcoming of the prior art because the conductors are kept within the confines of the magnetic field at all times, and the area to the front and rear of each diaphragm is predominately open.

Electrostatic and magnetic planar loudspeakers also suffer from high frequency beaming due to the large diaphragm area used to reproduce frequencies of sound whose wavelength is small compared to the size of the diaphragm. In the present invention high frequency beaming is prevented since the diaphragm may be any practical size to reproduce its intended frequencies.

Electrostatic and magnetic planar loudspeakers also suffer from a lack of bass capabilities unless the diaphragm area is extremely large, due to the fact the diaphragm movement is slight and the diaphragm is stretched so tightly on the frame.

In the present invention the woofer diaphragm may have a substantial amount of travel, thus aiding bass reproduction while minimizing surface area.

True ribbon loudspeakers, although generally regarded as superb tweeters, also lack in bass output due to the fact the resonant frequency of large ribbons is very low, and the ribbon is propelled out of the magnetic gap during playback of material with bass content. For this reason ribbon transducers are generally crossed over at a frequency well above their resonant frequency, thus affecting their bass response. In the present invention, large excursions of the woofer diaphragm are possible and bass response is not a problem.

SUMMARY OF THE INVENTION

The present invention is directed to a loudspeaker having a diaphragm with a fixed edge and a free edge, and a multiplicity of conductors running parallel to its length and adjacent to the free edge.

It is an object of the present invention to provide a new and improved loudspeaker having the best features of magnetic planar, conventional cone and ribbon loudspeaker technologies.

It is an object of the present invention to provide a new and improved loudspeaker having wide dispersion, excellent dynamic range, low distortion and wide frequency response.

It is an object of the present invention to provide a new and improved loudspeaker which has no restriction in its dynamic capabilities.

These and other objects and advantages of the present invention will be fully apparent from the following description, when taken in connection with the annexed drawings.

DESCRIPTION OF THE PREFERRED EMBODIMENT

Figure 1:
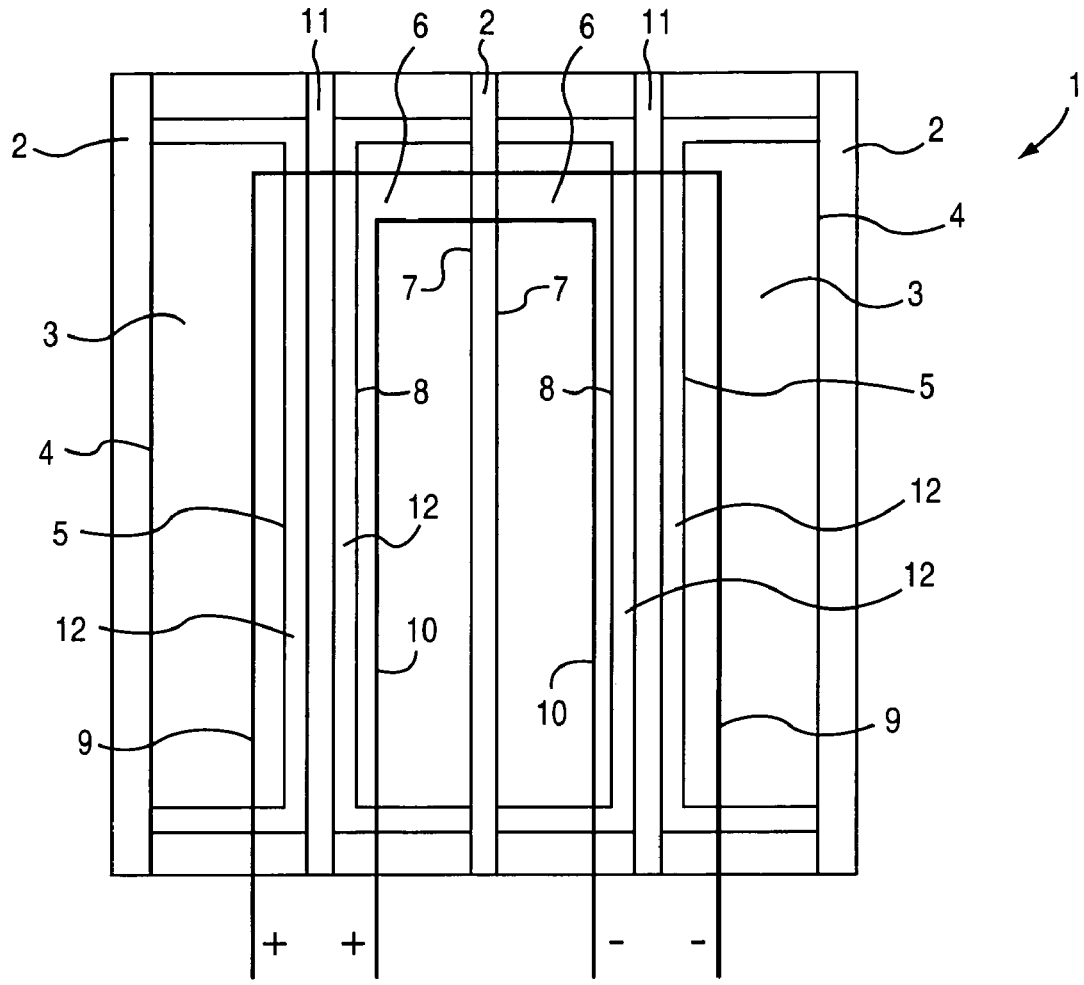
FIG. 1 is a plan view of the present invention.

Referring now to the drawings in greater detail, FIG. 1 shows the loudspeaker 1 of the present invention. The loudspeaker has a plurality of upper and lower supporting bars 2 (see also FIG. 2) for supporting the diaphragms 3 (woofers) and diaphragms 6 (tweeters). The supports 2 for the diaphragms 6 (tweeters) are preferably made from a material of high magnetic permeability such as iron or steel. The supporting bars 2 for the diaphragms 6 (tweeters) act as magnetic shielding directing the magnetic field on one tweeter diaphragm 6 away from the conductors on the other tweeter diaphragm 6. Each of the diaphragms 3 has a free edge 5, that is not attached to anything except the diaphragm itself, and a fixed edge 4, that is secured to the support 2. Each of the diaphragms 6 has a free edge 8, that is not attached to anything except the diaphragm itself, and a fixed edge 7.

The woofer and tweeter diaphragms are of a planar nature and may be constructed from a variety of materials such as, but not limited to, treated paper, polypropylene, mylar, polycarbonate, or any other conventional material. In addition, the diaphragms may be ribbed or otherwise modified to add stiffness, and the tweeter diaphragm itself may serve as both the diaphragm and the conductor. The diaphragms must be of a sufficient stiffness to provide the restorative force necessary to return the diaphragms to their resting or starting position after completion of an audio cycle, or else aided by another linear suspension and damping mechanism This restorative force is governed by the diaphragm composition, material thickness, and the width of the diaphragm from the fixed edge to the free edge.

Figure 2:
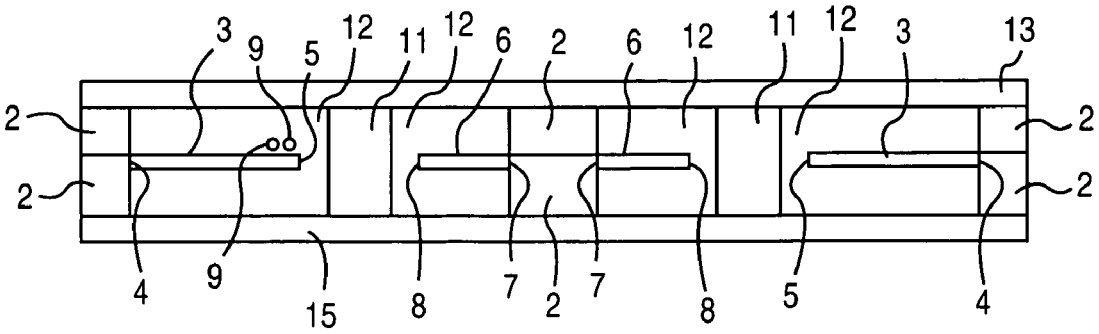
FIG. 2 is a top view of the present invention.

Conductors 9 are secured to the diaphragms 3 adjacent the free edges of the diaphragms. The conductors 9 run parallel to the longitudinal dimension of the diaphragms 3 as shown in FIG. 1 and are connected to an audio amplifier in any conventional manner. In addition, conductors 10 run parallel to the longitudinal dimension of the diaphragms 6 as shown in FIG. 1. It should be noted that only two conductors 9, 10 are shown in the drawings, however that is for illustration purposes only. More or fewer conductors can be used without departing from the scope of the invention. In addition, only conductors 9 are shown in FIG. 2. All other conductors have been removed for clarity. Conductors 9, 10 may be spread out over a useful width of the diaphragm to aid in cooling and to provide diaphragm excitation over a larger surface area, as long as the conductors are kept within the useful confines of the magnetic field. In fact, the entire width of the tweeter may house conductors.

Also, gaps 12 extend between the free edges of the diaphragms and any adjacent supports to allow the free edges 5, 8 to move. The free edges are positioned within the confines of a magnetic field created by the magnet assemblies 11. The magnets in the magnet assemblies are magnetized through their widths. That the magnet adjacent the first diaphragm is north/south, the second is south/north and so on. The magnets are preferably rare earth neodymium or large ferrite types since their usage may be justified by an increase in overall loudspeaker sensitivity; however, other types could also be used.

Upon application of an alternating current in an audio amplifier to conductors 9, 10, diaphragms 3, 6 oscillate about their fixed edges 4, 7. The resulting diaphragm movement describes an arc, and for all practical purposes may be considered semi-rotary movement, with the largest movement occurring at the free edges 5, 8 of the diaphragms. Since the diaphragm movement constitutes an arc, it would be advantageous, where cost is no object, to use arc segmented magnets similar to those used in electric motors to precisely follow the curvature described by each diaphragm's movement.

Figure 4:
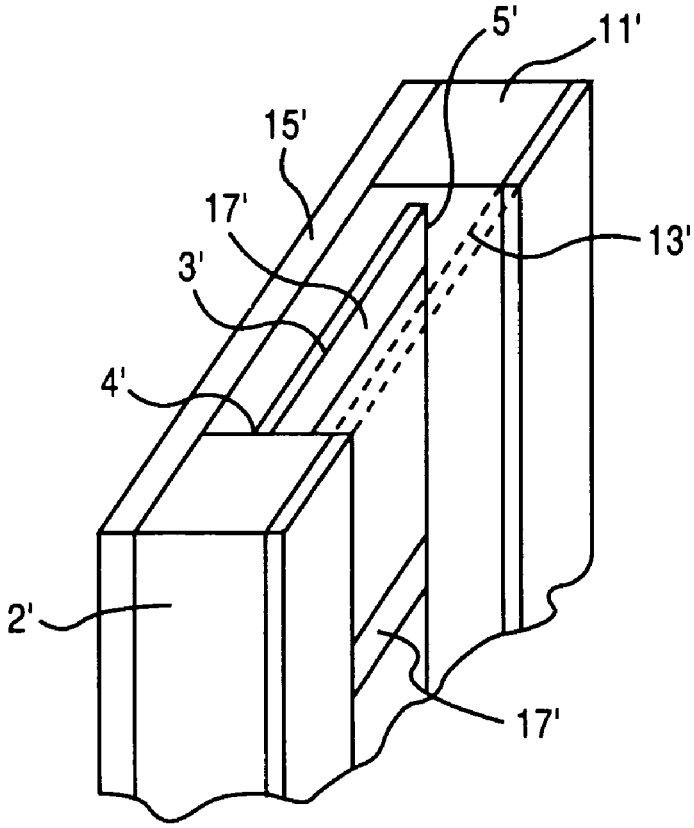
FIG. 4 is a partial perspective view of a modification of the present invention.

Since each magnetic pole of the magnet assembly serves to drive an individual audio transducer, a single diaphragm 3' can be used as shown in FIG. 4. In this case the diaphragm has a fixed end 4' and a free end 5', supports 2', magnet assembly 11' and front and rear covers 13', 15'. also shown in FIG. 4 is a supplementary suspension and damping mechanism 17'. This may consist of a very thin length of spring steel attached to the diaphragm's fixed edge 4' and affixed to and traversing the width of the diaphragm 3' at fixed spaced intervals along the diaphragm's longitudinal dimension. This provides a linear restoring force on the diaphragm 3' over its full range of excursion. The attraction of the spring steel at the free edge 5' to the centerline of the longitudinal dimension of the magnet assembly 11' results in a quick restoration of the diaphragm 3' to its equilibrium point. This magnetic damping aids in obtaining good diaphragm transient response and helps to control spurious diaphragm resonances. Alternative suspension and damping mechanisms may also be used which do not depart from the scope of this invention. In all other aspects the FIG. 4 device acts like the FIG. 1 device.

Figure 3:
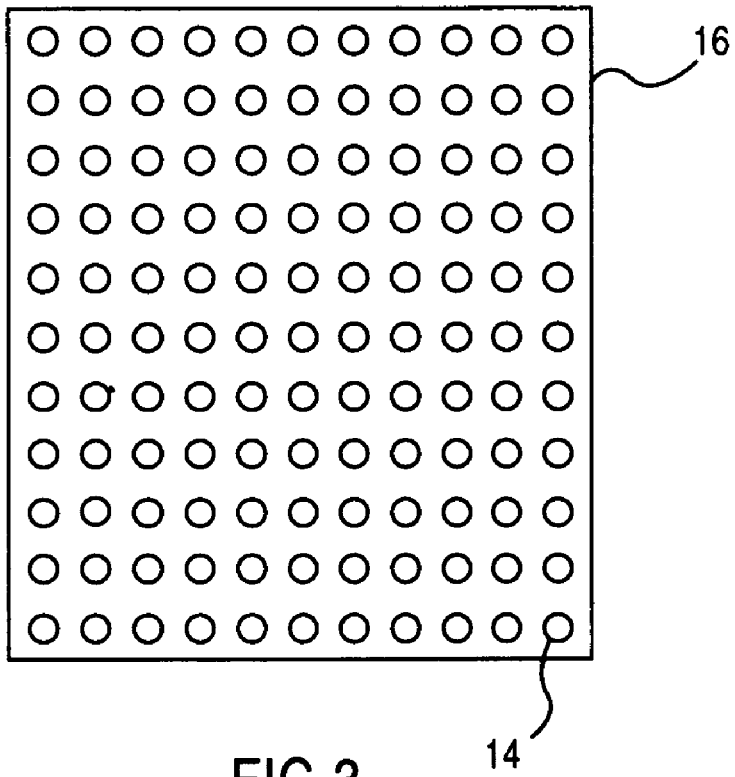
FIG. 3 is a plan view of one of the supports of the present invention.

Another embodiment of the invention is shown in FIG. 3, which shows a metal plate 16 which has a plurality of perforations 14 extending therethrough. The plate can be affixed to the rear of the loudspeaker framework providing support for the bars 2 and the magnet assemblies. This could result in lower construction and labor costs since these parts may be now made from less rigid materials.

Although the Unipole Radiator Loudspeaker and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A loudspeaker responsive to an electrical signal, said loudspeaker comprising:

at least one diaphragm, said at least one diaphragm having a surface area defined in part by opposing edges, one of said opposing edges being fixed to a support, and another of said opposing edges being free, means for oscillating said at least one diaphragm about said fixed opposing edge, and said means extending parallel to a length of said diaphragm, and wherein said loudspeaker has a support plate, and said support plate has a plurality of perforations extending therethrough.

2. The loudspeaker as claimed in claim 1, wherein there are at least two diaphragms, a woofer and a tweeter, and each of said two diaphragms having a fixed end and a free end.

3. The loudspeaker as claimed in claim 1, wherein said loudspeaker has at least one conductor, and said at least one conductor runs parallel to said length of said diaphragm.

4. The loudspeaker as claimed in claim 1, wherein said loudspeaker has at least one diaphragm that serves as both a diaphragm and conductor.

5. The loudspeaker as claimed in claim 1, wherein said means for oscillating said at least one diaphragm about said fixed opposing edge causes said free edge to move in an arc.

6. The loudspeaker as claimed in claim 1, wherein said loudspeaker has at least one diaphragm sided by a linear suspension mechanism.

7. The loudspeaker as claimed in claim 1, wherein said loudspeaker has at least one diaphragm with magnetic damping applied at the free edge.

8. A loudspeaker responsive to an electrical signal, said loudspeaker comprising:

at least two diaphragms, each of said at least two diaphragms having a surface area defined in part by opposing edges, one of said opposing edges being fixed to a support, and another of said opposing edges being free, means for oscillating said at least two diaphragms about said fixed opposing edges, and said means extending parallel to a length of said at least two diaphragms, and wherein said loudspeaker has a support plate, and said support plate has a plurality of perforations extending therethrough.

9. The loudspeaker as claimed in claim 8, wherein said loudspeaker has at least one conductor, and said at least one conductor runs parallel to said length of said at least two diaphragms.

10. The loudspeaker as claimed in claim 8, wherein said loudspeaker has at least one diaphragm that serves as both a diaphragm and conductor.

11. The loudspeaker as claimed in claim 8, wherein said means for oscillating said at least one diaphragm about said fixed opposing edges causes said free edges to move in an arc.

12. The loudspeaker as claimed in claim 8, wherein said loudspeaker has at least one diaphragm sided by a linear suspension mechanism.

13. The loudspeaker as claimed in claim 8, wherein said loudspeaker has at least one diaphragm with magnetic damping applied at the free edge.

* * * * *